US008272934B2

(12) United States Patent
Olive et al.

(10) Patent No.: US 8,272,934 B2
(45) Date of Patent: Sep. 25, 2012

(54) GAMING MACHINE AND METHOD FOR PROVIDING A BONUS AWARD

(75) Inventors: Scott Christopher Olive, Brookvale (AU); Kent Bradley Young, Reno, NV (US)

(73) Assignee: Aruze Gaming America, Inc., Las Vegas, NV (US)

( * ) Notice: Subject to any disclaimer, the term of this patent is extended or adjusted under 35 U.S.C. 154(b) by 504 days.

(21) Appl. No.: 12/410,571

(22) Filed: Mar. 25, 2009

(65) Prior Publication Data

US 2009/0247271 A1 Oct. 1, 2009

Related U.S. Application Data

(60) Provisional application No. 61/039,145, filed on Mar. 25, 2008.

(51) Int. Cl.
*A63F 9/24* (2006.01)

(52) U.S. Cl. ..... 463/16; 436/17; 436/19; 436/21; 273/138.1; 273/139

(58) Field of Classification Search ..... 436/16–22; 273/138.1, 139
See application file for complete search history.

(56) References Cited

U.S. PATENT DOCUMENTS

| | | | | |
|---|---|---|---|---|
| 5,947,820 | A | 9/1999 | Morro et al. | |
| 7,169,046 | B2 * | 1/2007 | Webb et al. | 463/20 |
| 7,503,848 | B2 * | 3/2009 | Berman et al. | 463/20 |
| 7,674,164 | B2 * | 3/2010 | Stefani | 454/154 |
| 7,841,936 | B2 * | 11/2010 | Berman et al. | 463/20 |
| 2003/0199310 | A1 * | 10/2003 | Kaminkow | 463/20 |
| 2006/0068884 | A1 * | 3/2006 | Baerlocher et al. | 463/20 |
| 2006/0068889 | A1 * | 3/2006 | Okada et al. | 463/20 |
| 2006/0068893 | A1 * | 3/2006 | Jaffe et al. | 463/20 |
| 2006/0094496 | A1 * | 5/2006 | Webb et al. | 463/20 |
| 2007/0117607 | A1 | 5/2007 | Olive | |
| 2007/0167217 | A1 * | 7/2007 | Kaminkow et al. | 463/20 |
| 2007/0287521 | A1 | 12/2007 | Glavich et al. | |
| 2008/0108411 | A1 * | 5/2008 | Jensen et al. | 463/20 |
| 2008/0311973 | A1 * | 12/2008 | Jaffe | 463/20 |

FOREIGN PATENT DOCUMENTS

AU 2004100360 7/2004

OTHER PUBLICATIONS

International Search Report and Written Opinion; May 15, 2009.

* cited by examiner

*Primary Examiner* — Hsien Ming Lee
(74) *Attorney, Agent, or Firm* — Howard & Howard Attorneys PLLC

(57) ABSTRACT

A game device and a method allow a player to play a game on the gaming machine. The gaming machine has a main display and a user interface. The game has a main game and a bonus game. The method includes the steps of (i) allowing the player to place a wager on the main game, (ii) playing the main game and randomly establishing a result of the main game, and (iii) awarding the player an award as a function of a paytable if the result of the main game is a win. The method further includes the steps of (iv) detecting an appearance of a predetermined bonus trigger symbol during the play of the main game and responsively, randomly selecting a bonus symbol from a set of bonus symbols, repeating steps (i)-(iv), and awarding the player a bonus award if a predetermined number of unique bonus symbols are selected.

16 Claims, 7 Drawing Sheets

GAMING MACHINE AND METHOD FOR PROVIDING A BONUS AWARD

RELATED APPLICATIONS

The present application claims priority to U.S. Provisional Patent Application Ser. No. 61/039,145 filed on Mar. 25, 2008, which is hereby incorporated by reference in its entirety.

FIELD OF THE INVENTION

The present invention relates generally to game devices, and more particularly to game device which allows a player to place a wager on a game and provides a payout and/or a bonus payout.

BACKGROUND OF THE INVENTION

It is well known to provide bonus awards or games or other types of secondary awards or games as an additional component to a casino game, such as a video slot machine. Typically, such bonus awards are awarded to the player when a special symbol appears, for example, on the reels of the video slot machine.

In some games, once the special symbol appears, the player may be automatically awarded a bonus, such as a set amount of credits or a multiplier.

Alternatively, once the special symbol appears, the player may be allowed to play a bonus game. The bonus game takes the player completely out of the main game, after which the player can play the video slot game again. The end result of the bonus game may be a bonus award.

However, neither of these types of bonus awards or games build any type of excitement or anticipation for the player during the main game.

The present invention is aimed at one or more of the problems identified above.

SUMMARY OF THE INVENTION

In a first aspect of the present invention, a game is provided on a gaming machine. The gaming machine has a main game and a bonus. The gaming machine may be, for example, a video slot machine. The bonus is triggered when a predetermined number of a predetermined symbol appear on the reels during one game or spin. The bonus may be, for example, 10 free games.

In a second aspect of the present invention, a game is provided on a gaming machine. The gaming machine has a main game and a bonus. The bonus may be triggered during the main game and may include a predetermined number of free games. For example, the gaming machine may be a video slot machine. During the main game or play of the video slot machine, the bonus may be triggered and a predetermined number of free games may be provided, e.g., 10 free games. During the free games, the player may be awarded prizes based on the play of the game (as in the main game).

In a third aspect of the present invention, during the predetermined number of free games, one or more awards may be awarded during play of the free games as a function of the collection of a set (or subset) of predetermined bonus symbols.

In a fourth aspect of the present invention, a game device and a method for allowing a player to play a game on the gaming machine is provided. The gaming machine has a main display and a user interface. The game has a main game and a bonus game. The method includes the steps of (i) allowing the player to place a wager on the main game, (ii) playing the main game and randomly establishing a result of the main game, and (iii) awarding the player an award as a function of a paytable if the result of the main game is a win. The method further includes the steps of (iv) detecting an appearance of a predetermined bonus trigger symbol during the play of the main game and responsively, randomly selecting a bonus symbol from a set of bonus symbols, repeating steps (i)-(iv), and awarding the player a bonus award if a predetermined number of unique bonus symbols are selected.

In a fifth aspect of the present invention, a gaming machine and a method for allowing a player to play a game on a gaming machine, is provided. The gaming machine has a main display and a user interface. The game has a main game and a bonus game. The method includes the steps of allowing the player to place a wager on the main game, playing the main game and randomly establishing a result of the main game, and awarding the player an award as a function of a paytable if the result of the main game is a win. The method also includes the steps of detecting the occurrence of a bonus trigger event during the play of the main game and awarding the player a number of free plays of the main game in response to detecting the occurrence of the bonus trigger event, playing the free plays of the main game, detecting an appearance of a predetermine trigger bonus symbol during the free plays of the main game and randomly selecting one of a set of bonus symbols, and awarding the player a bonus award if a predetermined number of unique bonus symbols are selected during the free plays of the main game.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF INVENTION

Figure 1:
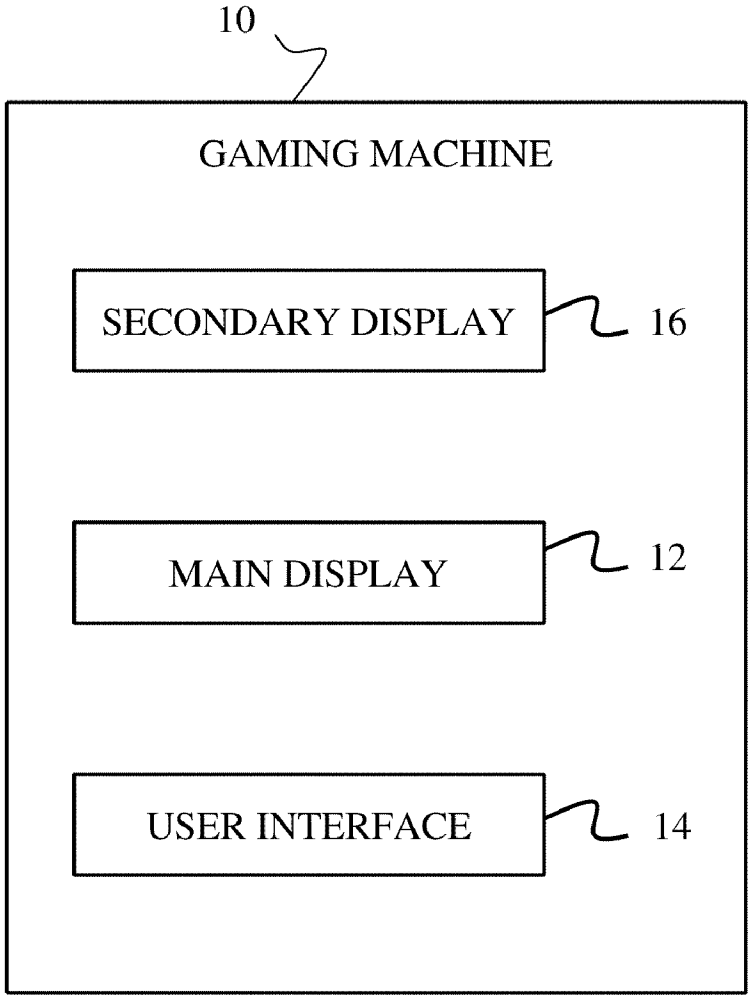
FIG. 1 is a block diagram of a game machine for providing a game having a main game and a bonus, according to an embodiment of the present invention.

Referring to the Figures, wherein like numerals indicate like or corresponding parts throughout the several views, a gaming machine 10 is provided. The gaming machine 10 allows a player to play a game thereon.

In the illustrated embodiment, the gaming machine 10 has a main display 12 and a user interface 14. The gaming machine 10 may take one of several forms. For example, the gaming machine 10 may be an upright or slant-top gaming machine which may be located in a casino (not shown). The user interface 14 may include one more buttons, card reader, bill reader, etc . . . , to allow the player to make wagers thereon and to interact with the gaming machine 10. Such gaming machines 10 are known in the prior art and are therefore not further discussed. Alternatively, the gaming machine 10 may be a desktop computer, laptop or notebook computer, cell phone or other computing or mobile device which allows the player to place wagers and play the game. Such gaming machines 10 may be connected to a server computer or remote computer (not shown) to facilitate the wagering aspect of the present invention. The user interface 14 will depend on the type of gaming machine 10, and may include without limitation, buttons, touchscreens, a keyboard and/or a keypad.

In one aspect of the present invention, the game has a main game and a bonus game. For example, the gaming machine 10 may be an electronic gaming machine 10 which provides a main game on the main display 12. In one embodiment, the main game is a video slot game. However other types of main games, such as a video poker, or the like, may also be provided. In the main game, the player makes a wager, plays the main game, and provides a main game award when a winning condition in the main game occurs. As is known in the art, the main game award is typically dependent upon the winning condition and a paytable. The bonus game provides a bonus award which is triggered using a bonus symbol collection feature.

The symbol collection feature utilizes a set or subset of predefined bonus symbols which when collected during a predefined game sequence results in a bonus award being provided or awarded to the player. The predefined game sequence can be either from the standard (base) game or free game feature. The symbol collection feature can be either one of the main game features or can be an extra feature bought into the game with an additional bet. As discussed below, the bonus collection feature can be a part of the main game. Alternatively, during the main game, the player may be awarded a predetermined number of free games (or free spins). The bonus collection feature may be a part of the free games.

In one aspect of the present invention, a bonus award is provided when, during the predefined game sequence, all or a subset of the bonus symbols are collected. For example, in one embodiment, the set of of bonus symbols includes 6 unique symbols (BS-1, BS-2, BS-3, BS-4 BS-5, BS-6). The predefined game sequence may be, for example, a predetermined number of plays of the main game or the free spins.

In one embodiment, the bonus award is awarded to the player if all six bonus symbols are collected during the predefined game sequence. Alternatively, a bonus award may be provided if a subset of the total bonus symbols are collected, e.g., 3 of the 6 bonus symbols. Additionally, a secondary bonus award, generally smaller than the bonus award, may be provided when each bonus symbol is collected.

In another aspect of the present invention, the player collects a random one of the bonus symbols when, during the predefined game sequence a predetermined bonus trigger symbol (P6) appears. If the predetermined bonus trigger symbol (P6) appears, then a random one of the bonus symbols is established or selected (see below).

As discussed above, in one embodiment the predefined game sequence may be a predetermined number of consequential main games. In the one embodiment, the player is first allowed to place a wager on the main game. The main game may be a mechanical or video slot game, video poker game or other game. Generally, the main game includes the appearance, selection and/or display of game symbols or indicia. The game symbols may take the form of playing cards and/or symbols on a reel. The main game is played and the result of the main game is randomly established. An award is payed to the player if the result of the main game is a win. Generally, the award is determined or established as a function of the result and a paytable. If during the main game, a predetermined bonus trigger symbol (P6) appears during the play of the main game, a bonus symbol from a set of bonus symbols is randomly selected. The player is allowed to play the main game repeatedly. If, during a predefined game sequence, e.g., a predetermined number of consequential plays of the main game, a predetermined number of unique bonus symbols are selected, then the player is awarded a bonus award.

Figure 2:
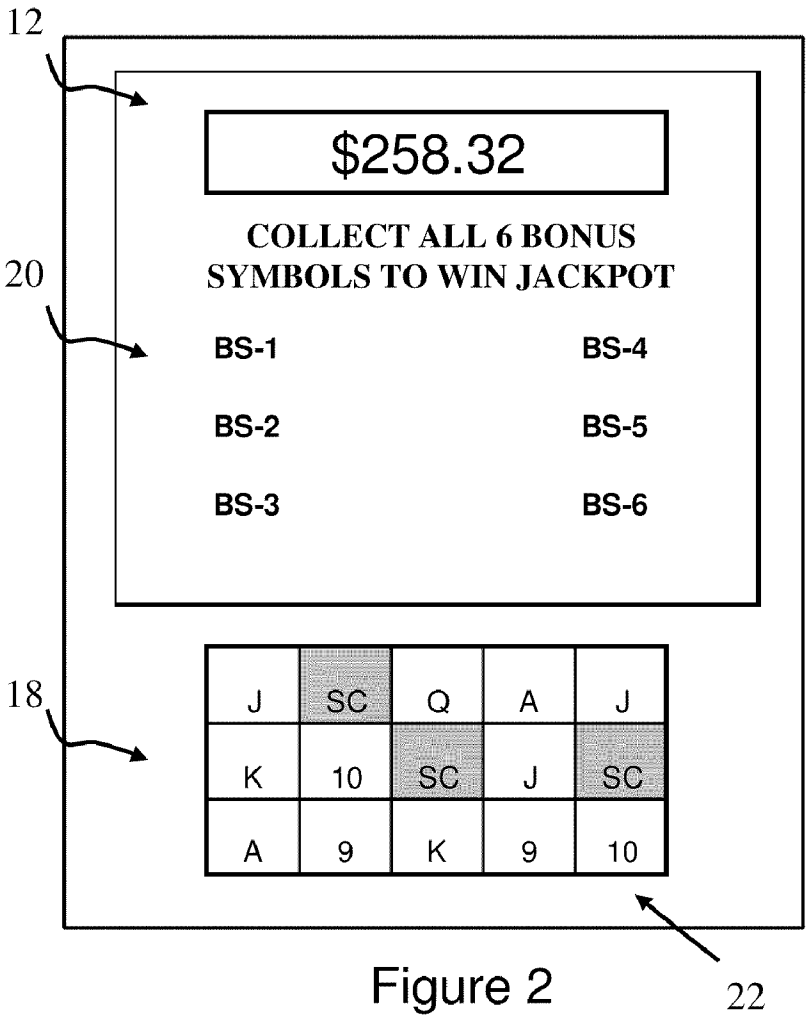
FIG. 2 is a graphical representation of a first screenshot of the game of FIG. 1.

With specific reference to FIG. 2, in one embodiment the main display 12 may have a first portion 18 and a second portion 20. The main game is displayed in the first portion 18. In the second portion 20, the bonus symbols, e.g., BS-1, BS-2, BS-3, BS-4, BS-5, BS-6, are displayed and an indication of when, or if, a specific bonus symbol has selected is also provided. For example, the bonus symbol may be outlined, highlighted, colored, or otherwise graphically modified when collected. Alternatively, the display may be otherwise modified to indicate collection. For example, in the illustrated embodiment, a mark, such as a check, may be displayed adjacent a respective bonus symbol when it is collected (see FIGS. 3-8).

In one embodiment, an animation may be displayed, draws the attention of the player to the fact that a bonus symbol has been collected. For example, during play of the game, the bonus predetermined bonus trigger symbol is first displayed. Then one of the bonus symbols is randomly selected. In the first portion 18 the predetermined bonus trigger symbol (P6) may be animated to change into (or morph) into the selected bonus symbol.

The gaming machine 10 may also include a secondary display 16 which may be, e.g., in a top box of the gaming machine 10. The bonus symbols and the indication of when the bonus symbols have been selected may be displayed on the main display 12 and/or the secondary display 16.

In additional the the bonus award, the player may be awarded an intermediate award when the bonus symbol is randomly selected. For example, each bonus symbol may have a different intermediate award associated therewith.

Alternatively, or in addition, the player may be awarded an intermediate award when a predetermined combination of the bonus symbols have been randomly selected or collected. For example, the player may be awarded an intermediate award when BS-1 and BS-3 have been collected during the predefined game sequence.

The bonus award may be a fixed amount, a standalone jackpot, a linked progressive jackpot, free games, multiplier, a bonus game, increased chance of winning, more wilds, more bonus symbols, more scatter symbols, a higher paytable for the main game and group or tournament play, or other award.

In another aspect of the present invention, the predefined game sequence may be a predetermined number of free plays of the main game. For example, the player may be allowed to place a wager on the main game. The game is played and the player is awarded an award as a function of a paytable if the result of the main game is a win. During the play of the main game, if a bonus trigger event occurs, e.g., the appearance of a special symbol, then the player may be awarded a number of free plays of the main game. The bonus symbol collection feature then may be associated with the free plays of the main game.

Industrial Applicability

With particular reference to FIGS. 2-8, one embodiment of the present invention is shown with a bonus jackpot prize which is triggered from a symbol collection feature during free plays of the main game. The symbol collection feature is a set or subset of predefined symbols (BS-1, BS-2, BS-3, BS-4, BS-5, BS-6) which when collected during a predefined game sequence, a bonus jackpot prize is awarded.

In the illustrated embodiment, the main game is a video slot game. The reel strips 22 of the video slot game are displayed in the first portion 18 of the main displayed. During the game sequence, as the bonus symbols are collected they appear or are displayed on the main display 12 above the reel strips 22, to indicate to the player the game progress and how many symbols they still require before they qualify for the bonus. Alternatively they may also be shown on the secondary display 16.

In one embodiment of the invention, a player is awarded 10 free games. During the free games whenever a special designated symbol appears anywhere on the screen, it will animate and reveal 1 of 6 different bonus symbols. A small prize may be paid depending upon which bonus symbol is revealed (e.g. a prize of 50, 100, 250, 375, 500 or 1000 credits (multiplied by credits bet per line) is paid for bonus symbol #1, #2, #3, #4, #5 or #6 revealed respectively). The revealed bonus symbols are collected and displayed both on the main display 12 and the secondary display 16 so the player can monitor their progress during the free games. If all 6 different bonus symbols are collected during the free games feature, a bonus jackpot prize is paid also. If less than all 6 different bonus symbols are accumulated during the free games feature no bonus jackpot prize is paid.

In another embodiment, the bonus jackpot prize is paid when a subset of the bonus symbols are collected. The bonus jackpot prize may also be related to the number of different bonus symbols collected. For example, collecting 3 of 6 different bonus symbols may award a bonus jackpot prize, however collecting all 6 different bonus symbols may award a different bonus jackpot prize. In another embodiment collecting 2 of 6 different bonus symbols may award 25% of the bonus jackpot prize, collecting 4 of 6 different bonus symbols may award an additional 25% of the bonus jackpot prize, however accumulating all 6 different bonus symbols may award 100% of the total bonus jackpot prize.

In another embodiment, there may be predefined combinations of bonus symbols which need to be collected to win different jackpot prizes. For example, to win the larger bonus jackpot prize a player might need to collect bonus symbols #1, #2 & #3. To win the smaller bonus jackpot prize a player might need to collect bonus symbols #4, #5 & #6. In a further embodiment, an additional jackpot prize is also paid if all 6 bonus symbols are collected.

In another embodiment, as different bonus symbols are revealed, the player might advance up a prize ladder toward bigger prizes (e.g. if the game sequence starts at the bottom of the ladder, bonus symbol #1 might need to be collected to move up to the first rung of the ladder. To move up another rung of the ladder bonus symbol #2 might need to be collected. To reach the top of the ladder and win the bonus prize the player must collect all 6 bonus symbols. The bonus symbols may or may not be required to be collected in order). At the end of the free games feature, whatever rung of the ladder the player finishes on is the prize which is awarded. In a further embodiment, the different bonus symbols may award different numbers of advances up the ladder e.g. bonus symbol #1 moves the player one rung up the ladder, bonus symbol #2 moves the player two rungs up the ladder.

In another embodiment, the special designated symbol might be a die, which animates and reveals a number between 1 and 6. These numbers might be added together during the free games feature, and the sum score at the end of the free games feature used to award the bonus jackpot prize (e.g. a sum score of 30 awards the small bonus jackpot prize, a score of 40 awards the medium bonus jackpot prize. A sum score of 75+ awards the large bonus jackpot prize). In another embodiment, the sum score of the die at the end of the free games feature is related to the award of different portions of the bonus jackpot prize (e.g. a sum score of 30 awards ¼ of the bonus jackpot prize, a score of 40 awards ½ of the bonus jackpot prize. A sum score of 75+ awards the total bonus jackpot prize). In another embodiment, the special designated symbol being a die, might animate and reveal a symbol instead of a number which are accumulated and award bonus jackpot prizes.

With specific reference to FIG. 2, in the illustrated embodiment 10 free games are won when 3, 4 or 5 of a scatter symbol <SC> appear during the main game. During the free games all <P6> appearing anywhere in the window reveal a Bonus Symbol of either <BS-1>, <BS-2>, <BS-3>, <BS-4>, <BS-5> or <BS-6>. A prize of 1000, 500, 375, 250, 100 or 50 (multiplied by credits bet per line) is paid for each Bonus Symbol respectively. If during the free games feature all 6 Bonus Symbols are collected, the JACKPOT is also won. The free games feature may be won again during the free games. The JACKPOT can be won during the free game feature. In the screenshot of FIG. 2, three of the scatter symbols appear during the main game, so the player has won 10 free games or spins. The results of the first 6 free games are shown in FIGS. 3-8, respectively. All free game wins are paid first.

Figure 3:
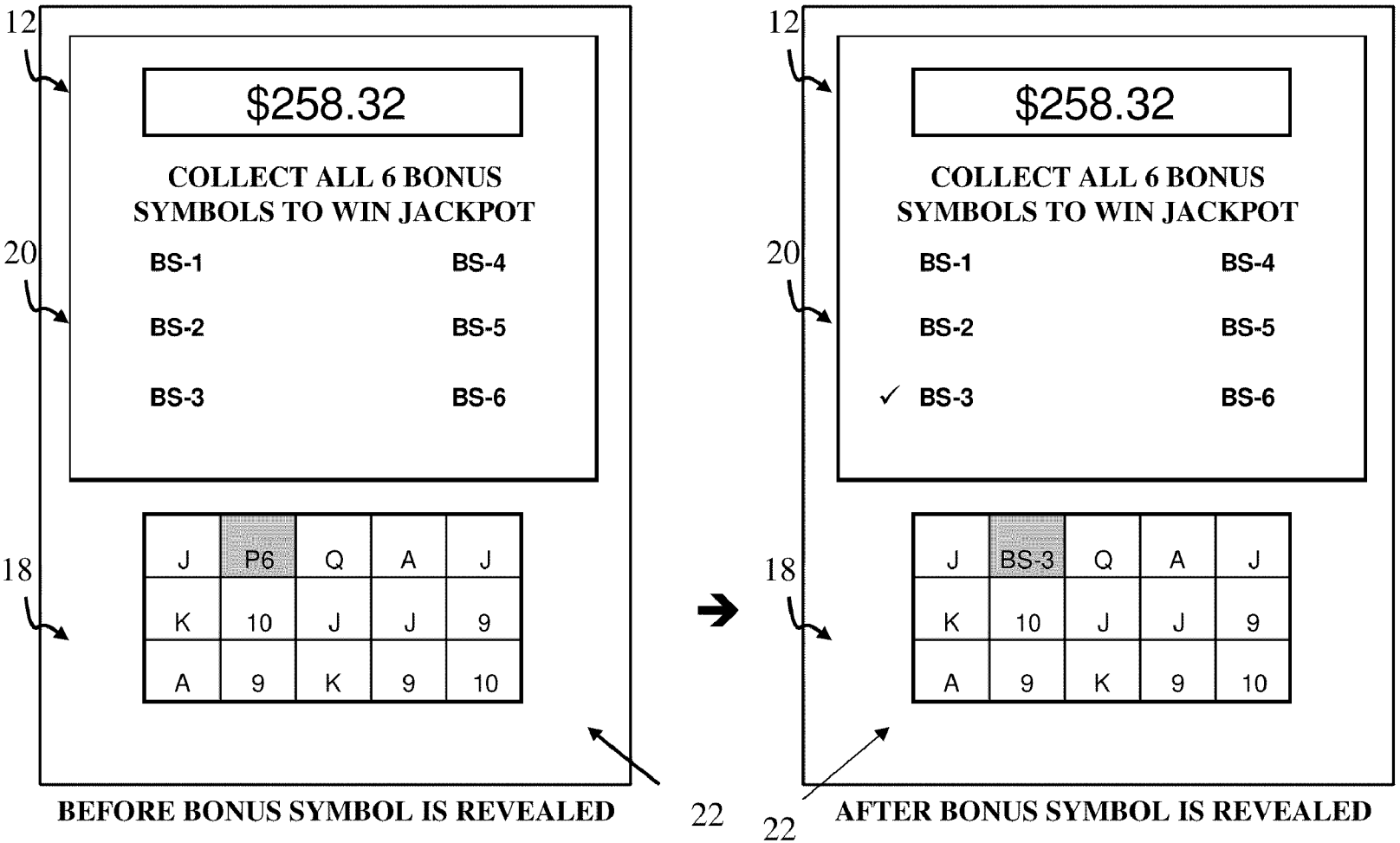
FIG. 3 is a graphical representation of a pair of screenshots from a first free game, according to an embodiment of the present invention.

FIG. 3 contains two screen shots of the main display 12. In the first screen shot, the predetermined bonus trigger symbol <P6> has appeared during the first free play and the bonus symbol <BS-3> is randomly selected. The <P6> symbol on reel 2 animates and reveals <BS-3> Bonus Symbol (second screenshot).

The <BS-3> symbol in the second portion 20 of the main display 12 is highlighted to indicate to the player they have revealed that symbol, but still require the other 5 Bonus Symbols (i.e. <BS-1>, <BS-2>, <BS-4>, <BS-5> & <BS-6>) before they qualify for the JACKPOT. 375 credits are paid to win meter for the <BS-3> win.

Figure 4:
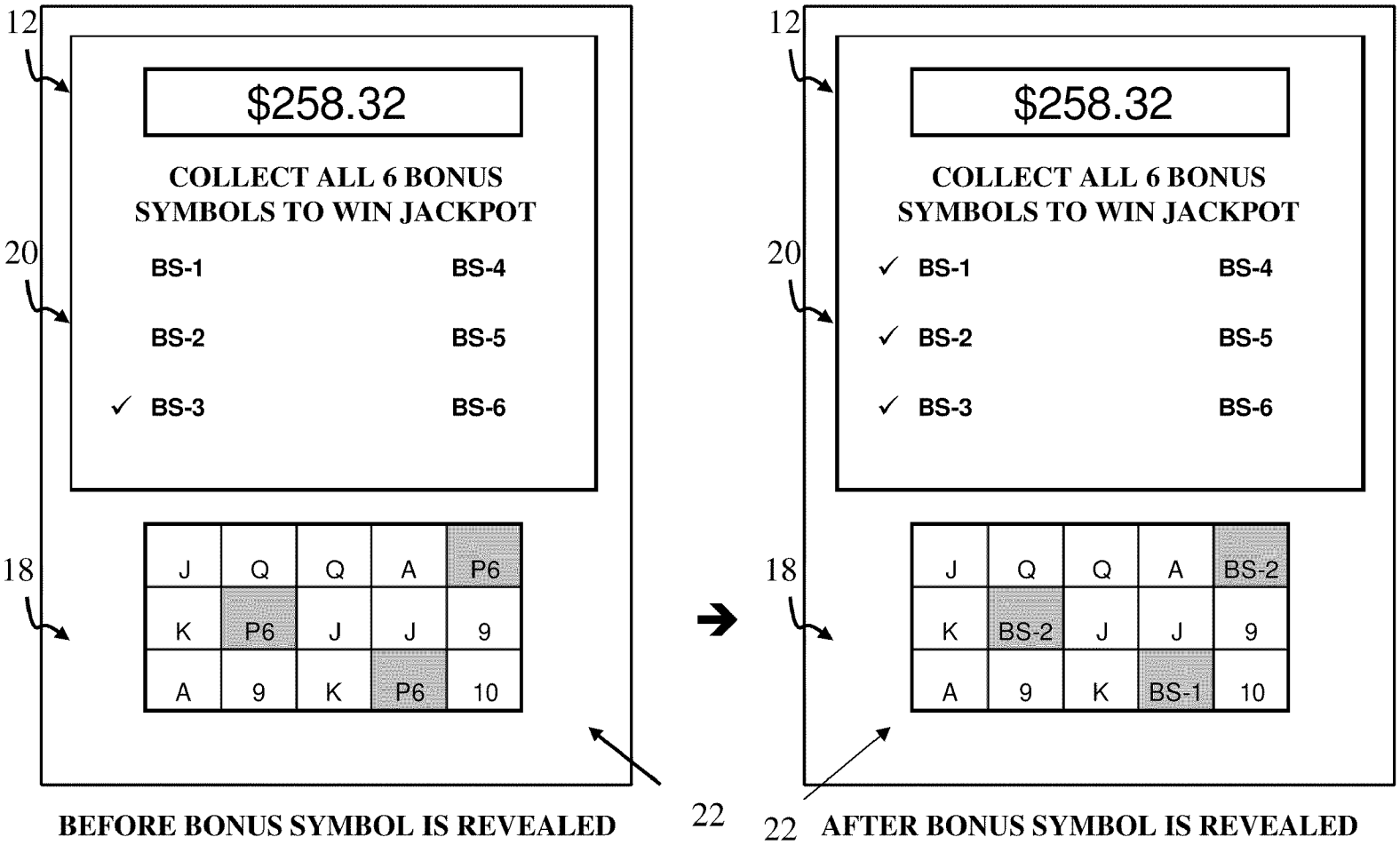
FIG. 4 is a graphical representation of a pair of screenshots from a second free game, according to an embodiment of the present invention.

FIG. 4 shows two screen shots of the second free game. In the first screen shot, the predetermined bonus trigger symbol <P6> has appeared during the second free play and the bonus symbol <BS-2> is randomly selected. The <P6> symbol on reel 2 animates and reveals <BS-2> Bonus Symbol (second screenshot). The <BS-2> symbol is highlighted to indicate to the player they have revealed that symbol, but still require the other 4 Bonus Symbols (i.e. <BS-1>, <BS-4>, <BS-5> & <BS-6>) before they qualify for the JACKPOT. 500 credits are paid to win meter for the <BS-2> win.

Once the <BS-2> win has been paid, <P6> on reel 4 animates next and reveals <BS-1> Bonus Symbol. The <BS-1> symbol is highlighted to indicate to the player they have revealed that symbol, but still require the other 3 Bonus Symbols (i.e. <BS-4>, <BS-5>& <BS-6>) before they qualify for the JACKPOT. 1000 credits are paid to win meter for the <BS-1> win. Once the <BS-1> win has been paid, <P6> on reel 5 animates next and reveals <BS-2> Bonus Symbol. Because the <BS-2> symbol has already been revealed and highlighted, only the credits win is paid. The player still requires the other 3 Bonus Symbols (i.e. <BS-4>, <BS-5> & <BS-6>) before they qualify for the JACKPOT. 500 credits paid to win meter for the <BS-2> win.

Figure 5:
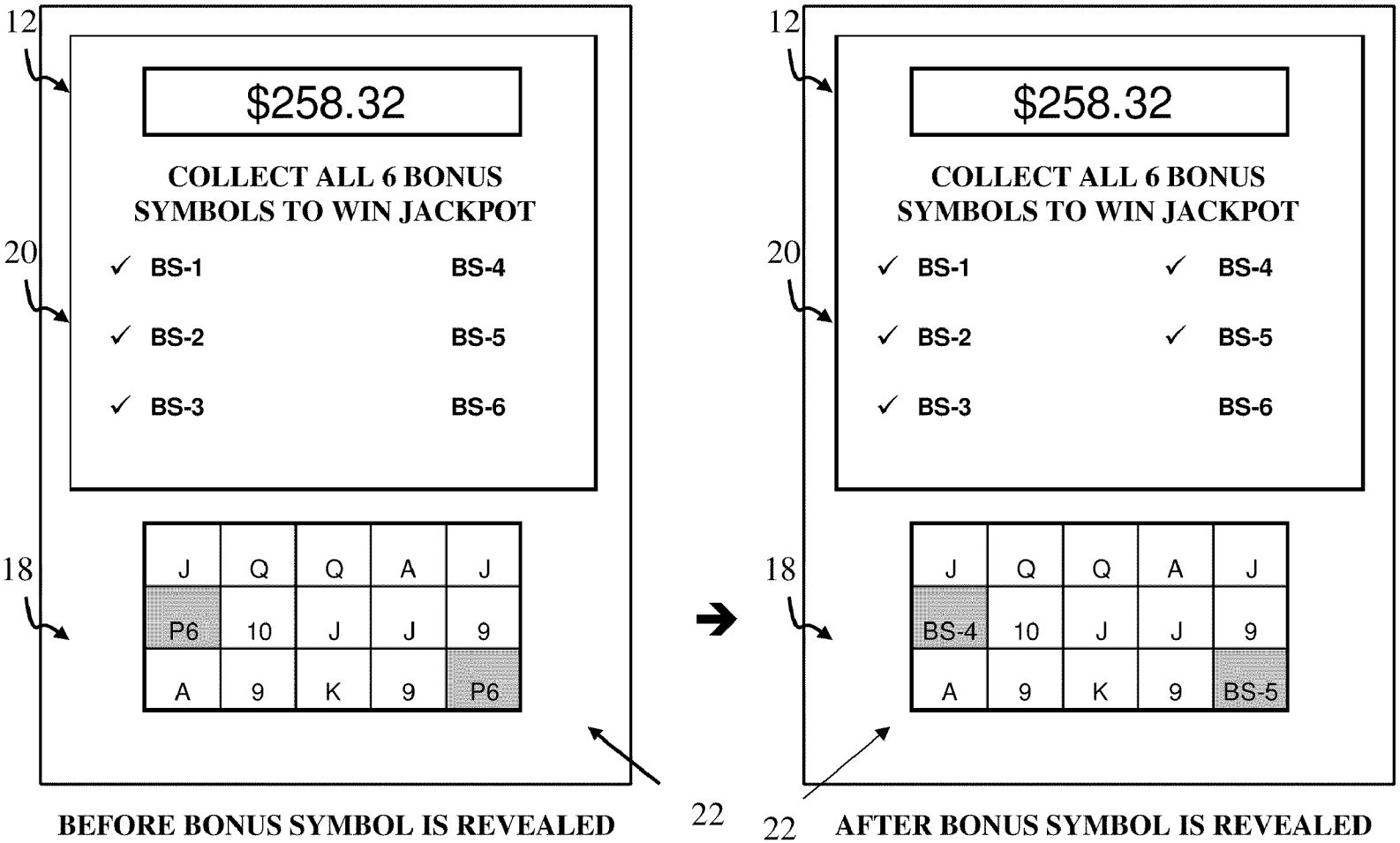
FIG. 5 is a graphical representation of a pair of screenshots from a third free game, according to an embodiment of the present invention.

FIG. 5 contains two screen shots of the main display 12. In the first screen shot, the predetermined bonus trigger symbol <P6> has appeared during the third free play and the bonus symbol <BS-4> is randomly selected. The <P6> symbol on reel 1 animates and reveals <BS-4> Bonus Symbol (second screenshot). The <BS-4 > symbol is highlighted to indicate to the player they have revealed that symbol, but still require the other 2 Bonus Symbols (i.e. <BS-5> & <BS-6>) before they qualify for the JACKPOT. 250 credits are paid to win meter for the <BS-4> win.

Once the <BS-4> win has been paid, <P6> on reel 5 animates next and reveals <BS-5> Bonus Symbol. The <BS-5 > symbol is highlighted to indicate to the player they have revealed that symbol, but still require the remaining Bonus Symbol (i.e. <BS-6>) before they qualify for the JACKPOT. 100 credits paid to win meter for the <BS-5> win.

Figure 6:
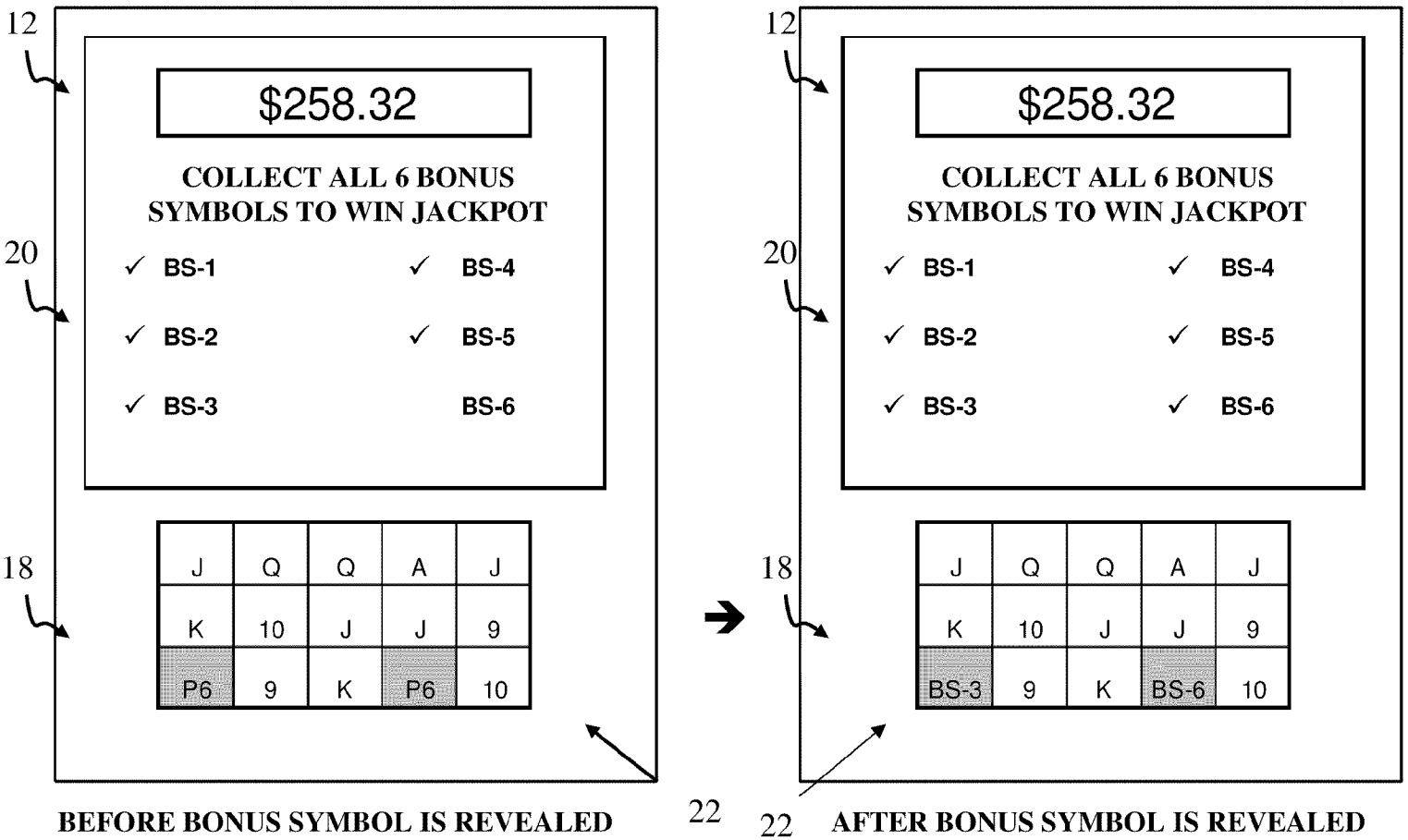
FIG. 6 is a graphical representation of a pair of screenshots from a fourth free game, according to an embodiment of the present invention.

FIG. 6 contains two screen shots of the main display 12. In the first screen shot, the predetermined bonus trigger symbol <P6> has appeared during the fourth free play and the bonus symbol <BS-3> is randomly selected. The <P6> symbol on reel 1 animates and reveals <BS-3> Bonus Symbol (second screenshot). Because the <BS-3 > symbol has already been revealed and highlighted, only the credits win is paid. The player still requires the remaining Bonus Symbol (i.e. <BS-6>) before they qualify for the JACKPOT. 375 credits are paid to win meter for the <BS-3> win. Once the <BS-3> win has been paid,<P6> on reel 4 animates and reveals <BS-6> Bonus Symbol. The <BS-6 > symbol is highlighted to indicate to the player they have revealed that symbol. Because all 6 Bonus Symbols have been revealed, the JACKPOT is paid. 375 credits paid to win meter for the <BS-6> win first. $258.32 then paid to win meter for the JACKPOT win.

The Jackpot amount is reset to $100 startup amount. All highlighted symbols above the reel strips are turned off to indicate to the player that the jackpot has been paid and reset. The JACKPOT can be won again during the free game feature.

Figure 7:
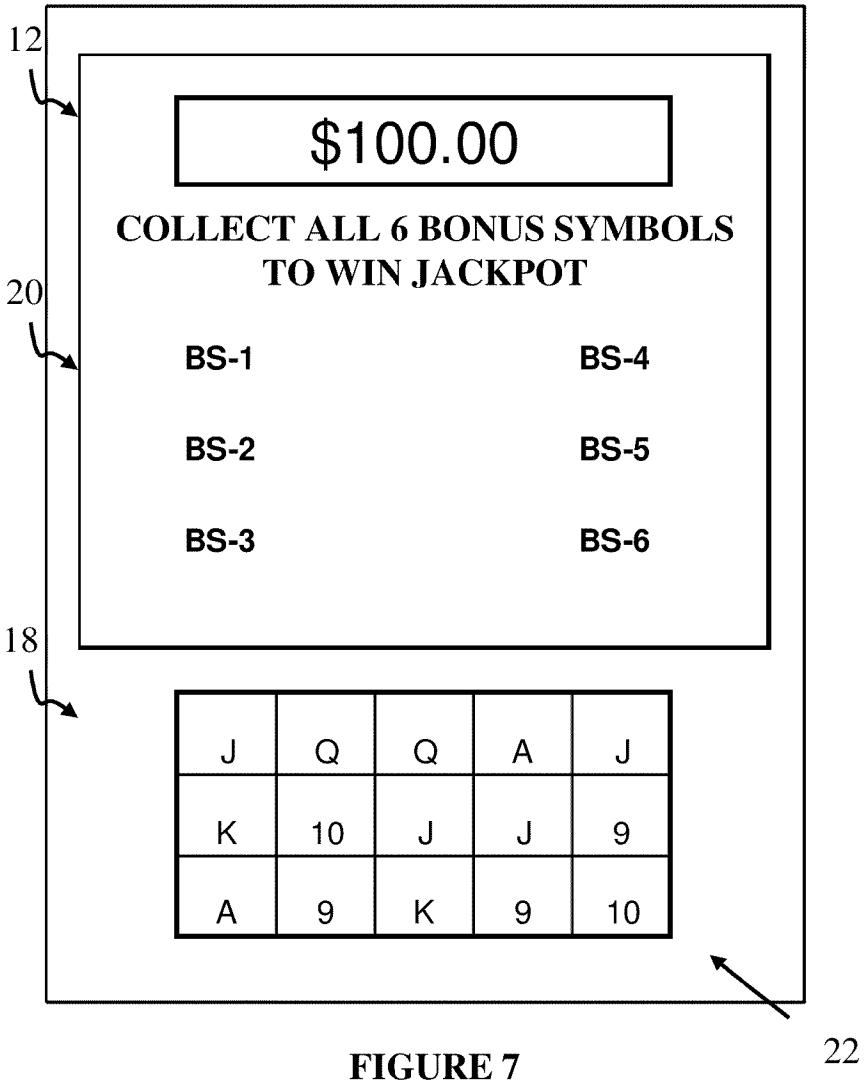
FIG. 7 is a graphical representation of a screenshot from a fifth free game, according to an embodiment of the present invention; and, FIG. 8 is a graphical representation of a pair of screenshots from a sixth free game, according to an embodiment of the present invention.

FIG. 7 contains a screen shot of the main display 12 of the fifth free game. Since there is no win, the next free game plays.

Figure 8:
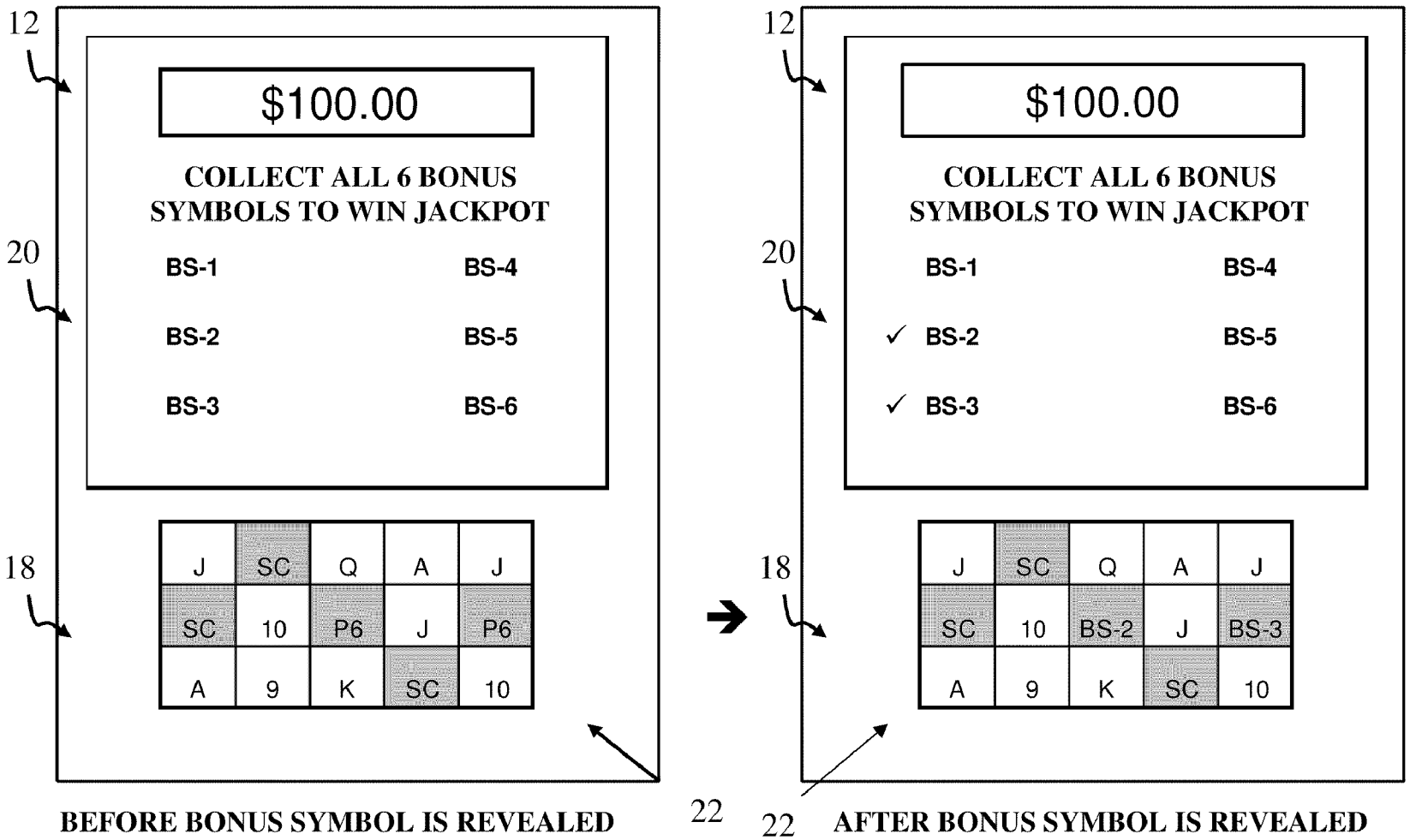

FIG. 8 contains two screen shots of the main display 12. In the first screen shot, the predetermined bonus trigger symbol <P6> has appeared during the sixth free play and the bonus symbol <BS-2> is randomly selected. The <P6> symbol on reel 3 animates and reveals <BS-2> Bonus Symbol (second screenshot). The <BS-2> symbol is highlighted to indicate to the player they have revealed that symbol, but still require the other 5 Bonus Symbols (i.e. <BS-1>, <BS-3>, <BS-4>, <BS-5> & <BS-6>) before they qualify for the JACKPOT again. 500 credits are paid to win meter for the <BS-2> win. Once the <BS-2> win has been paid, <P6> on reel 5 animates next and reveals <BS-3> Bonus Symbol. The <BS-3> symbol is highlighted to indicate to the player they have revealed that symbol, but still require the other 4 Bonus Symbols (i.e. <BS-1>, <BS-4>, <BS-5> & <BS-6>) before they qualify for the JACKPOT again. 375 credits are paid to win meter for the <BS-3> win.

Since 3 <SC> are displayed, the player has won an additional 10 free games.

The free games feature continues until all remaining free games have been played.

Obviously, many modifications and variations of the present invention are possible in light of the above teachings. The invention may be practiced otherwise than as specifically described within the scope of the appended claims.

What is claimed is:

1. A method for allowing a player to play a game on a gaming machine, the gaming machine having a main display and a user interface, the game having a main game and a bonus game, the method comprising the steps of:

allowing the player to place a wager on the main game;

playing the main game and randomly establishing a result of the main game;

awarding the player an award as a function of a paytable if the result of the main game is a win;

detecting the occurrence of a bonus trigger event during the play of the main game and awarding the player a number of free plays of the main game in response to detecting the occurrence of the bonus trigger event;

playing the free plays of the main game;

detecting an appearance of a trigger bonus symbol during the free plays of the main game and randomly selecting one unique bonus symbol of a set of unique bonus symbols;

displaying an animation in place of the appearance of the trigger bonus symbol;

displaying the randomly selected one of a set of bonus symbols in place of the animation; and awarding the player a bonus award if all of the unique bonus symbols are selected during the free plays of the main game.

2. A method, as set forth in claim 1, the method including the steps of displaying the set of unique bonus symbols and providing an indication when each unique bonus symbol has been selected.

3. A method, as set forth in claim 2, wherein the animation after the appearance of the trigger bonus symbol shows the collection of the randomly selected unique bonus symbol.

4. A method, as set forth in 3, wherein the gaming machine includes a main display, the main game being displayed on the main display.

5. A method, as set forth in claim 4, wherein the unique bonus symbols and the indication of when the unique bonus symbols have been selected are displayed on the main display.

6. A method, as set forth in claim 3, the gaming machine includes a secondary display, wherein the unique bonus symbols and the indication of when the unique bonus symbols have been selected are displayed on the secondary display.

7. A method, as set forth in claim 1, including the step of awarding the player an intermediate award when the unique bonus symbol is randomly selected.

8. A method, as set forth in claim 7, wherein the intermediate award is chose from a fixed amount award, a standalone jackpot, a link progressive jackpot, free games, multiplier, a bonus game, increased chance of winning, additional wilds, additional bonus symbols, or additional scatter symbols.

9. A method, as set forth in claim 7, wherein the size of the intermediate award is dependent on the unique bonus symbol randomly selected.

10. A method, as set forth in claim 1, including the step of awarding the player an intermediate award when a combination of unique bonus symbols are randomly selected.

11. A method, as set forth in claim 1, wherein the bonus award is a fixed amount.

12. A method, as set forth in claim 1, wherein the bonus award is one of a standalone jackpot or a linked progressive jackpot.

13. A method, as set forth in claim 1, wherein the bonus award is one of: a number of free games, an award multiplier, a bonus game, increased chance of winning the main game, an increased number of wild symbols in the main game, a scatter win, increased paytable for the main game and group or tournament play.

14. A method, as set forth in claim 1, wherein the main game is a video slot game.

15. A method, as set forth in claim 1, wherein the main game is a mechanical stepper slot game with a secondary video display overlay.

16. A method, as set forth in claim 1, wherein the main game is a video poker game.

* * * * *